US010403454B2

(12) United States Patent
Singh et al.

(10) Patent No.: US 10,403,454 B2
(45) Date of Patent: Sep. 3, 2019

(54) CIRCUIT BREAKER SYSTEM AND SAFETY OPERATING HANDLE FOR A CIRCUIT BREAKER SYSTEM

(71) Applicant: ABB S.P.A., Milan (IT)

(72) Inventors: Gagandeep Singh, Memphis, TN (US); Daniel Lightsey, Collierville, TN (US)

(73) Assignee: ABB Schweiz AG, Baden (CH)

( * ) Notice: Subject to any disclaimer, the term of this patent is extended or adjusted under 35 U.S.C. 154(b) by 181 days.

(21) Appl. No.: 15/194,140

(22) Filed: Jun. 27, 2016

(65) Prior Publication Data

US 2017/0372856 A1 Dec. 28, 2017

(51) Int. Cl.

| | |
|---|---|
| ***H01H 19/20*** | (2006.01) |
| ***H01H 19/04*** | (2006.01) |
| ***H01H 19/14*** | (2006.01) |
| ***H01H 9/22*** | (2006.01) |
| ***H01H 71/56*** | (2006.01) |
| *H01H 9/28* | (2006.01) |

(52) U.S. Cl.

CPC ..... *H01H 19/20* (2013.01); *H01H 9/22* (2013.01); *H01H 19/04* (2013.01); *H01H 19/14* (2013.01); *H01H 71/56* (2013.01); *H01H 9/281* (2013.01)

(58) Field of Classification Search

CPC ..... H01H 19/14; H01H 19/20; H01H 19/22; H01H 9/282; H01H 9/281; H01H 71/56; H01H 9/22

See application file for complete search history.

(56) References Cited

U.S. PATENT DOCUMENTS

| | | | | |
|---|---|---|---|---|
| 3,337,245 | A | 8/1967 | Prange | |
| 4,612,424 | A * | 9/1986 | Clark | H01H 9/22 200/330 |
| 5,637,843 | A * | 6/1997 | Joyce | H01H 43/10 200/38 B |
| 6,958,456 | B1 | 10/2005 | Jur et al. | |
| 6,969,813 | B1 | 11/2005 | Winslett et al. | |
| 6,974,922 | B2 | 12/2005 | Bortolloni et al. | |
| 7,238,903 | B2 | 7/2007 | Fischer | |
| 7,368,675 | B2 | 5/2008 | Ishido et al. | |
| 8,100,443 | B2 | 1/2012 | Talpe | |
| 8,115,127 | B2 | 2/2012 | Nguyen et al. | |

(Continued)

OTHER PUBLICATIONS

Patent Cooperation Treaty, International Search Report and Written Opinion cited in counter-part PCT Patent Application No. PCT/US2017/039395, dated Aug. 28, 2017 (7 pages).

*Primary Examiner* — Felix O Figueroa

(74) *Attorney, Agent, or Firm* — Taft Stettinius & Hollister LLP; J. Bruce Schelkopf

(57) ABSTRACT

A circuit breaker system includes an internal operating handle disposed inside an enclosure and coupled to a shaft extending from a circuit breaker. The internal operating handle includes a dog clutch coupled to the shaft and a rotary handle coupled to the dog clutch. The rotary handle is operative to rotate the shaft when the dog clutch is engaged. A safety operating handle system for turning a shaft to operate a circuit breaker includes a rotary handle and a dog clutch having a first clutch member coupled to the rotary handle and having a second clutch member coupled to the shaft. The dog clutch is operative to transmit a rotation of the rotary handle to the shaft when the first clutch member is in an engagement position.

20 Claims, 6 Drawing Sheets

(56) References Cited

U.S. PATENT DOCUMENTS

| | | | | |
|---|---|---|---|---|
| 9,425,588 | B2 * | 8/2016 | Fischer | H01H 9/22 |
| 9,679,733 | B2 * | 6/2017 | Dunker | H01H 71/52 |
| 2009/0107819 | A1 * | 4/2009 | Samudrikam | H01H 3/20 200/336 |
| 2016/0099117 | A1 * | 4/2016 | Dunker | H01H 9/223 337/12 |

* cited by examiner

CIRCUIT BREAKER SYSTEM AND SAFETY OPERATING HANDLE FOR A CIRCUIT BREAKER SYSTEM

TECHNICAL FIELD

The present application generally relates to circuit breaker systems and more particularly, but not exclusively, to circuit breaker systems and safety operating handle systems for circuit breaker systems.

BACKGROUND

Circuit breaker systems remain an area of interest. Some existing systems have various shortcomings, drawbacks and disadvantages relative to certain applications. For example, in some circuit breaker systems, it is desirable that an internal safety operating handle require a deliberate action to turn the circuit breaker on. Accordingly, there remains a need for further contributions in this area of technology.

SUMMARY

One embodiment of the present invention is a unique circuit breaker system. Another embodiment is a unique safety operating handle system. Other embodiments include apparatuses, systems, devices, hardware, methods, and combinations for circuit breaker systems, safety operating handles and related components. Further embodiments, forms, features, aspects, benefits, and advantages of the present application shall become apparent from the description and figures provided herewith.

BRIEF DESCRIPTION OF THE FIGURES

The description herein makes reference to the accompanying drawings wherein like reference numerals refer to like parts throughout the several views, and wherein.

DETAILED DESCRIPTION OF THE ILLUSTRATIVE EMBODIMENTS

Figure 1:
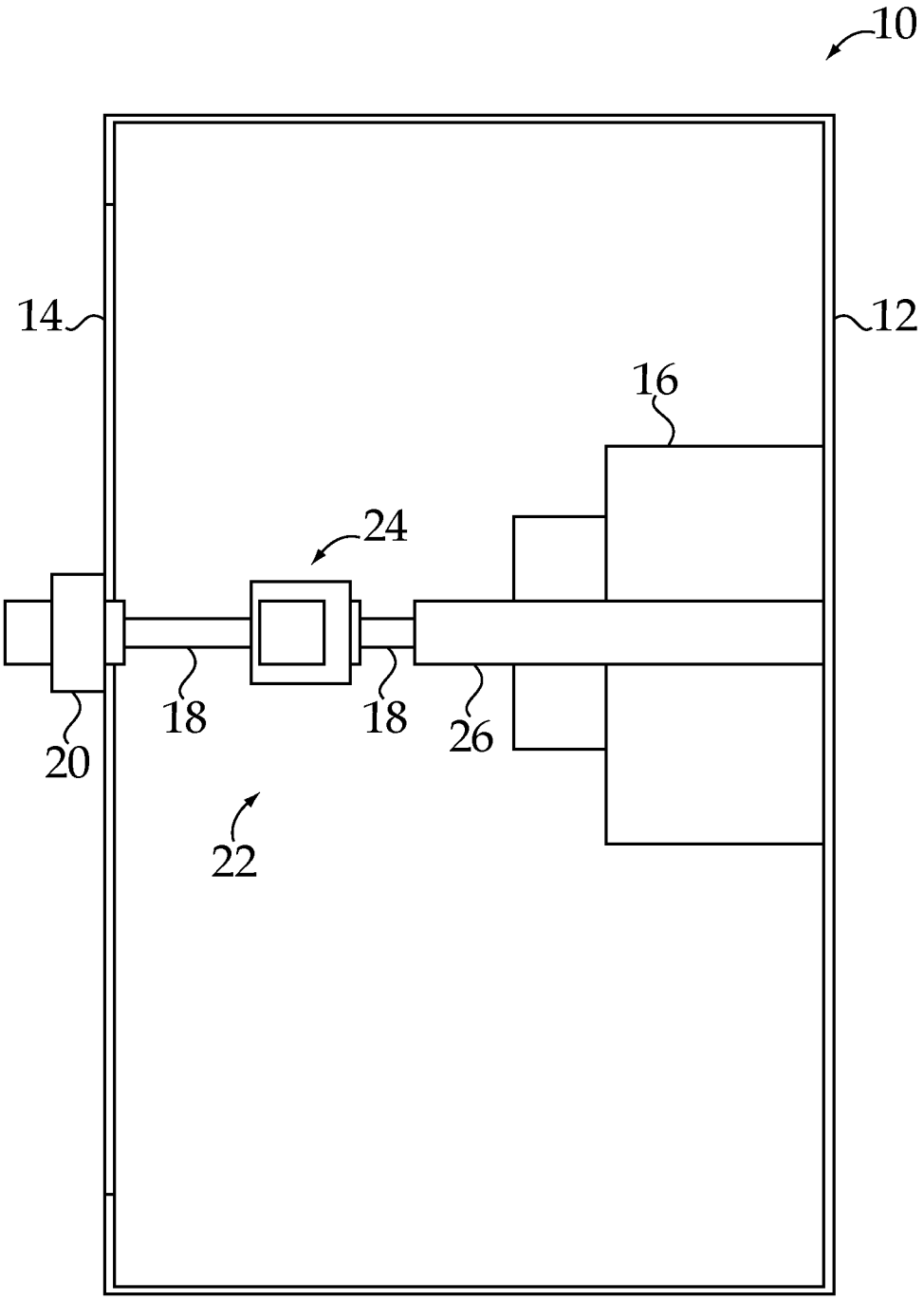
FIG. 1 illustrates some aspects of a non-limiting example of a circuit breaker system in accordance with an embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
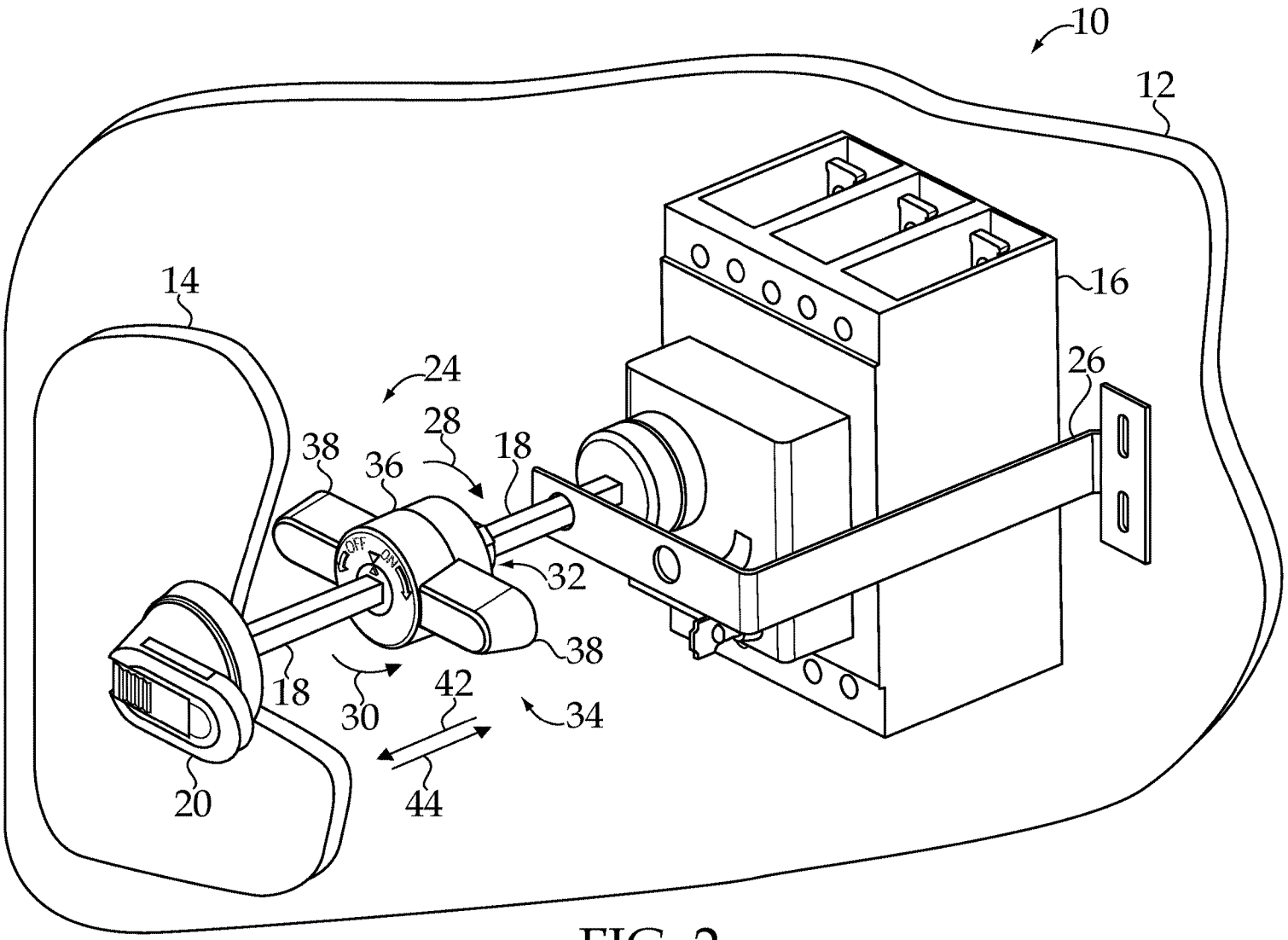
FIG. 2 is a front isometric view illustrating some aspects of a non-limiting example of the circuit breaker system of FIG. 1 in accordance with an embodiment of the present invention.
Figure 3:
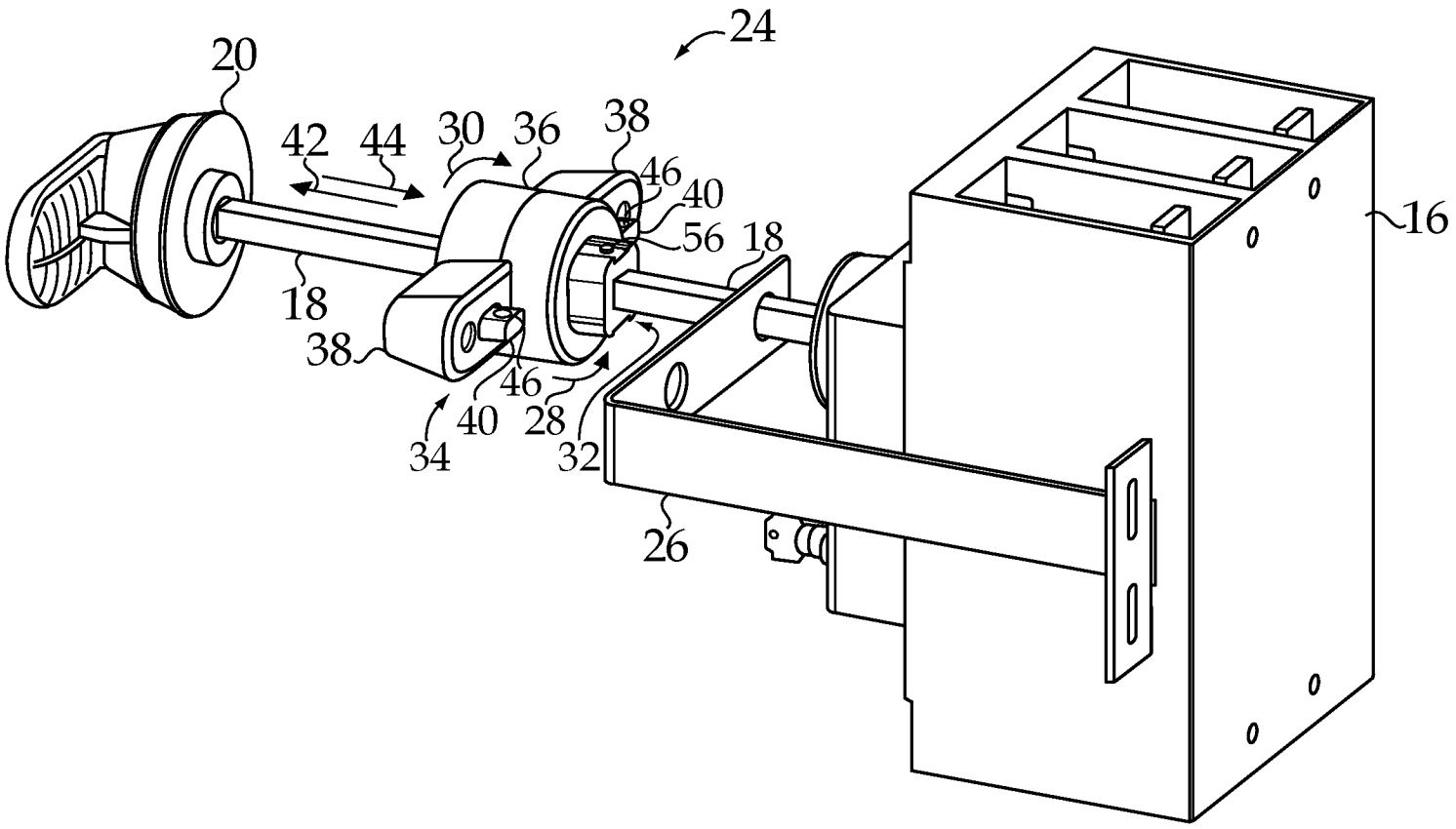
FIG. 3 is a rear isometric view illustrating some aspects of a non-limiting example of the of the circuit breaker system of FIG. 1 in accordance with an embodiment of the present invention.
Figure 4:
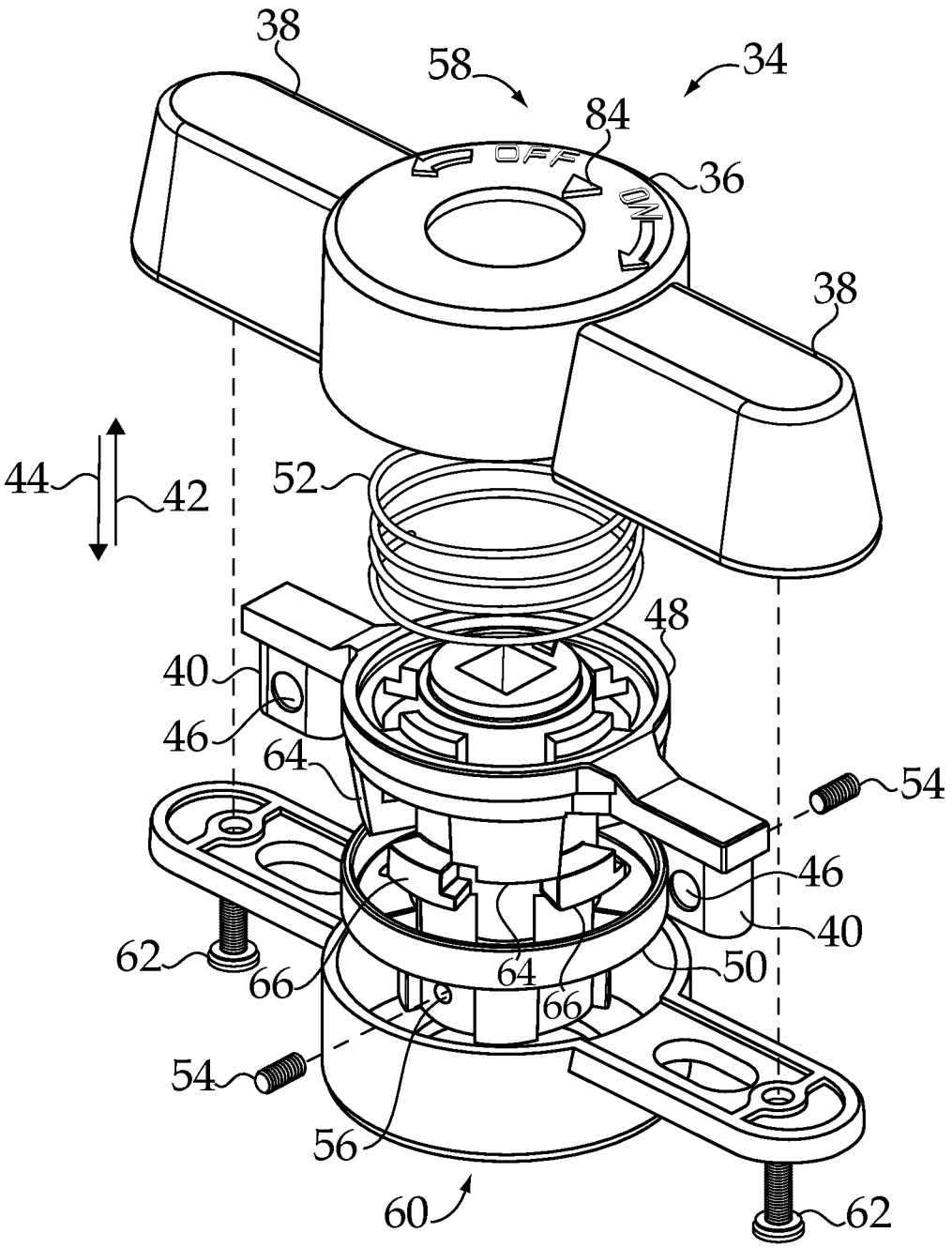
FIG. 4 illustrates an exploded perspective view of some aspects of a non-limiting example of a safety operating handle in accordance with an embodiment of the present invention.
Figure 5:
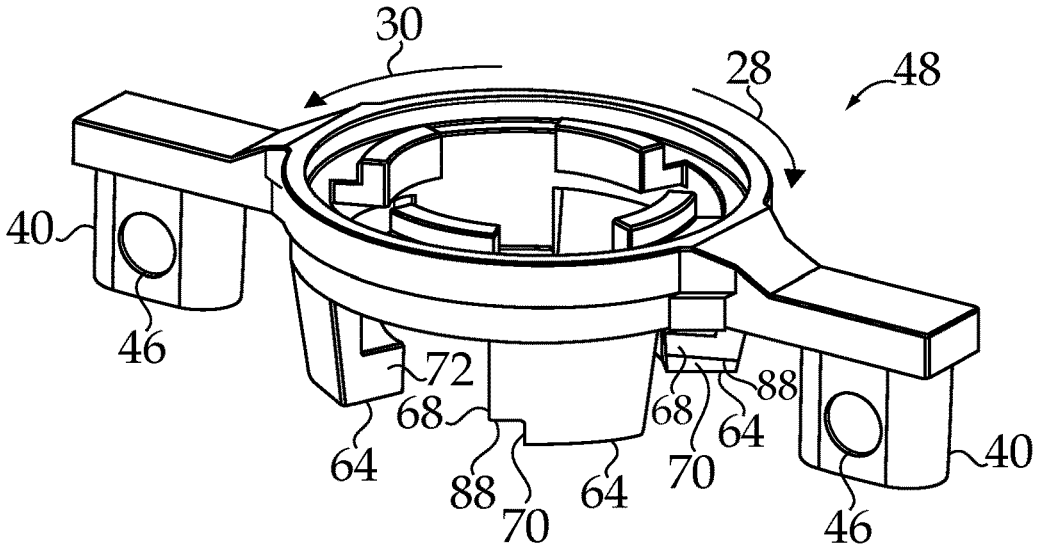
FIG. 5 illustrates some aspects of a non-limiting example of a clutch member in accordance with an embodiment of the present invention.

Referring to FIGS. 1-3, some aspects of a non-limiting example of a circuit breaker system 10 in accordance with an embodiment of the present invention are schematically depicted in a side view into a cabinet or enclosure 12. Circuit breaker system 10 includes cabinet or enclosure 12 having a door 14; a circuit breaker 16 having a shaft 18 extending therefrom; an operating handle 20; a safety operating handle system 22 having an internal safety operating handle 24 mounted on shaft 18 inside enclosure 12, and a shaft support bracket 26.

Enclosure 12 may be any circuit breaker enclosure. In one form, door 14 is a hinged door. In other embodiments, door 14 may be a removable access panel. Door 14 provides access to the interior of enclosure 12, e.g., to permit access to circuit breaker 16, electrical connections thereto, safety operating handle system 22 and any other electrical or other components housed within enclosure 12.

Circuit breaker 16 is disposed in enclosure 12. In the illustrated embodiment, circuit breaker 16 is an industrial circuit breaker, although in other embodiments, circuit breaker 16 may be any circuit breaker. In one form, circuit breaker 16 is a 400 Amp circuit breaker. In other embodiments, circuit breaker 16 may be any size/capacity. Shaft 18 is operative to rotate to turn circuit breaker 16 on and off. In one form, a clockwise rotation 28 is operative to turn circuit breaker 16 on, whereas a counterclockwise rotation 30 is operative to turn circuit breaker 16 off. In other embodiments, the rotation directions for turning circuit breaker 16 on and off may be reversed. During normal operation, door 14 is closed, and external operating handle 20, e.g., a pistol handle, is coupled to shaft 18 through door 14, and is operative to rotate shaft 18 to turn circuit breaker 16 on and off. When door 14 is open, operating handle 20 is disconnected from shaft 18.

It is desirable that some circuit breaker enclosures provide an on-off circuit breaker operator handle in the interior of the cabinet or enclosure. Accordingly, safety operating handle system 22 is provided. Safety operating handle 24 is disposed inside enclosure 12, and coupled to shaft 18. In one form, shaft 18 is a continuous shaft that extends from circuit breaker 16, through safety operating handle 24 to operating handle 20 (when door 14 is closed). In other embodiments, shaft 18 may be segmented. Safety operating handle 24 is operative to turn circuit breaker 16 on and off when door 14 of enclosure 12 is open. Shaft support bracket 26 is operative to support shaft 18 when door 14 is open, and when safety operating handle 24 is being used. Safety operating handle 24 requires a deliberate action in order to turn the circuit breaker on, e.g., depressing a button and rotating safety operating handle 24 as described herein. In one form, safety operating handle 24 is free-standing, i.e., mounted solely on shaft 18, and not mounted in whole or in part on another structure, such as enclosure 12. In other embodiments, safety operating handle 24 may be mounted on another structure in addition to or in place of shaft 18, e.g., may be mounted on circuit breaker 16.

Safety operating handle 24 includes a dog clutch 32 coupled to shaft 18 and a rotary handle 34 coupled to dog clutch 32. In other embodiments, other clutch types may be employed. Rotary handle 34 is constructed to be gripped by a left and/or right human hand for operating circuit breaker 16. Rotary handle 34 is operative to rotate shaft 18, but only when dog clutch 32 is engaged. Rotary handle 34 has a central portion 36 and wings 38 extending from central portion 36, e.g., for gripping with a human hand. Extending from the back side of each wing 38 toward circuit breaker 16 is a button 40. Either or both of buttons 40 are operative to engage dog clutch 32 when depressed, which couples rotary handle 34 to shaft 18 via dog clutch 32. Depressing buttons 40 translates or displaces buttons 40 in an axial direction 42 or engagement direction 42 along shaft 18 away from circuit breaker 16 and toward and into wings 38 of rotary handle 34 to engage dog clutch 32. Buttons 40 are spring-biased toward opposite axial direction 44 or disengagement direction 44 for disengaging dog clutch 32. When buttons 40 are not depressed, dog clutch 32 is not engaged, and rotary handle 34 is operative to freewheel, without imparting rotation to shaft 18.

Each button 40 has a hole or opening 46 extending therethrough. Each opening 46 is constructed to receive a lock, e.g., a padlock, to prevent the engagement of clutch 32 by preventing the displacement of buttons 40 toward and into rotary handle 34. In one form, only a single lock post engaging a single opening 46 is required to prevent the engagement of dog clutch 32, although in other embodiments, a lock mechanism having posts that engages both openings 46 may be required.

Referring to FIGS. 4-8, some aspects of a non-limiting example of a non-limiting example of safety operating handle 24 in accordance with an embodiment of the present invention are illustrated. Dog clutch 32 includes a first clutch member 48 and a second clutch member 50. Buttons 40 are operative to translate or displace first clutch member 48 in engagement direction 42 into an engagement position that engages clutch member 48 with clutch member 50 to engage clutch 32. Dog clutch 32 is operative to transmit rotation of rotary handle 34 to shaft 18 when clutch member 48 is in the engagement position. Dog clutch 32 does not transmit the rotation to shaft 18 when clutch member 48 is not in the engagement position. A bias spring 52 is operative to bias clutch member 48 in disengagement direction 44 toward a disengagement position to disengage clutch member 48 from clutch member 50 and thus disengage dog clutch 32. In one form, clutch member 50 is mounted on shaft 18 and secured or affixed to shaft 18 by set screws 54 threaded into openings 56 in clutch member 50. In other embodiments, clutch member 50 may be coupled to shaft 18 by other means. Clutch member 48 is coupled to rotary handle 34 and mounted on clutch member 50, and is operative to displace in axial engagement and disengagement directions 42 and 44 based on respective depressing of buttons 40 and the biasing force from bias spring 52.

Rotary handle 34 has two (2) halves 58 and 60 that are secured to each other with screws 62. Rotary handle 34 houses clutch member 48, clutch member 50 and bias spring 52, which are secured between and inside of or substantially inside of halves 58 and 60 of rotary handle 34 after the halves 58 and 60 are attached together with screws 62. Buttons 40 are coupled to clutch member 48. In one form, buttons 40 are integral with clutch member 48. In other embodiments, buttons 40 may not be integral with clutch member 48. Clutch member 48 has a plurality of driving teeth 64 for driving a plurality of corresponding driven teeth 66 of clutch member 50 in clockwise direction 28 and/or counterclockwise direction 30 for turning circuit breaker on and/or off, i.e., depending on the direction in which rotary handle 34 is rotated. Teeth 64 and 66 operatively extend in a direction parallel to shaft 18.

Referring to FIG. 5-8, driving teeth 64 of clutch member 48 include clockwise driving surfaces 68 and 70 and counterclockwise driving surfaces 72. Driven teeth 66 of clutch member 50 include clockwise driven surfaces 74 and 76 and counterclockwise driven surfaces 78. When clutch member 48 is in the engagement position, dog clutch 32 is engaged, and driving teeth 64 are disposed between driven teeth 66, rotationally coupling clutch member 48 with clutch member 50 by rotationally aligning driving surfaces 68, 70 and 72 with respective driven surfaces 74, 76 and 78 for transmitting rotation from rotary handle 34 to shaft 18 through the respective driving and driven surfaces. Clockwise driving surfaces 68 and 70 correspond to and drive against clockwise driven surfaces 74 and 76 when dog clutch 32 is engaged and rotary handle 34 is rotated in clockwise direction 28 to drive clutch component 50 and hence shaft 18 in clockwise direction 28 to turn circuit breaker 16 on. Counterclockwise driving surfaces 72 correspond to and drive against counterclockwise driven surfaces 78 when dog clutch 32 is engaged and rotary handle 34 is rotated in counterclockwise direction 30 to drive clutch component 50 and hence shaft 18 in counterclockwise direction 30 to turn circuit breaker 16 off.

Figure 6:
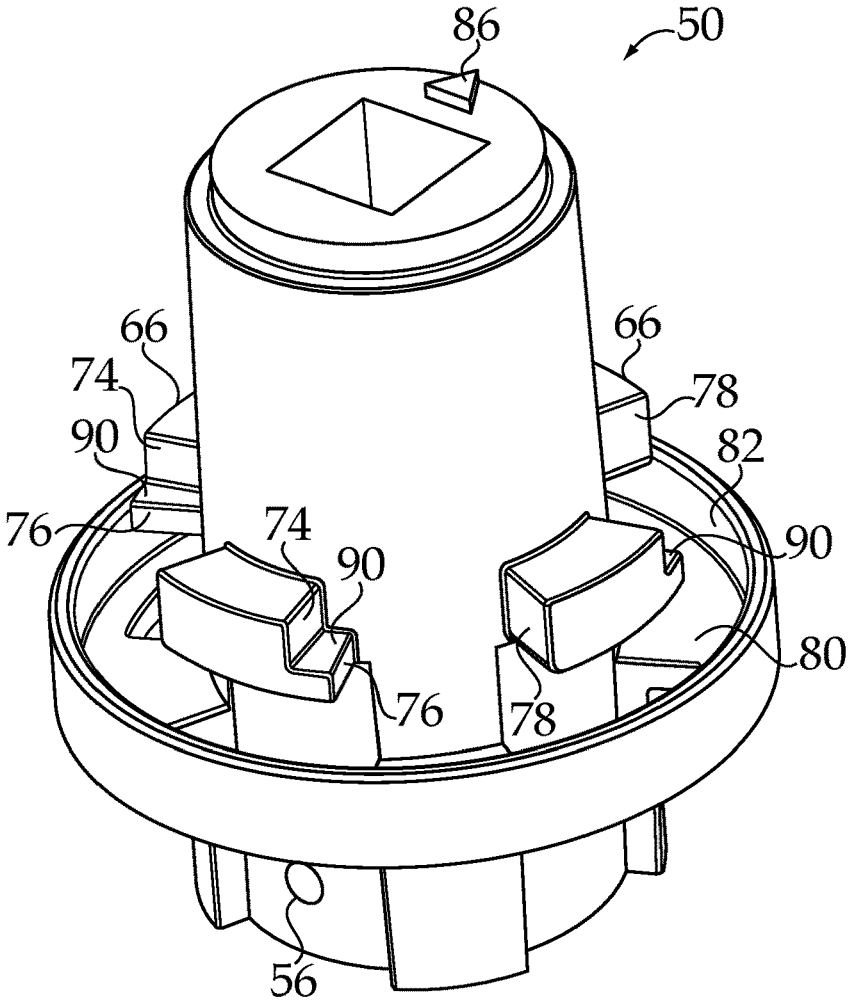
FIG. 6 illustrates some aspects of a non-limiting example of another clutch member in accordance with an embodiment of the present invention.
Figure 7:
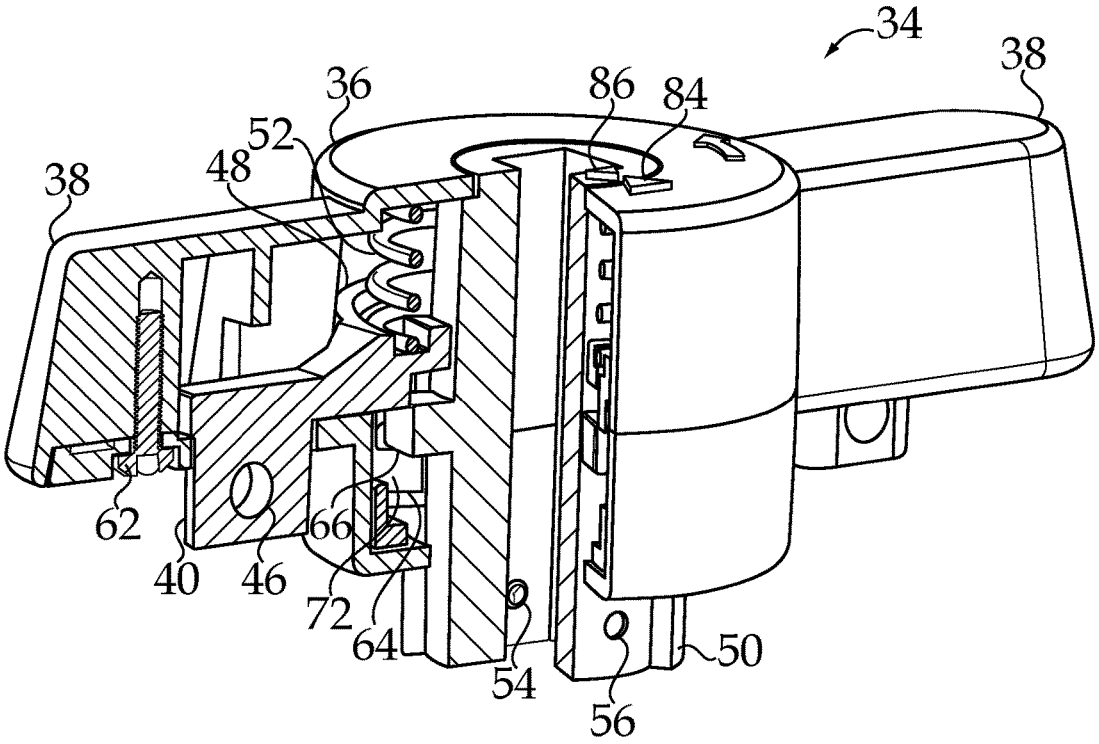
FIG. 7 illustrates some aspects of a non-limiting example of a clutch having a first clutch member in a disengagement position in accordance with an embodiment of the present invention.
Figure 8:
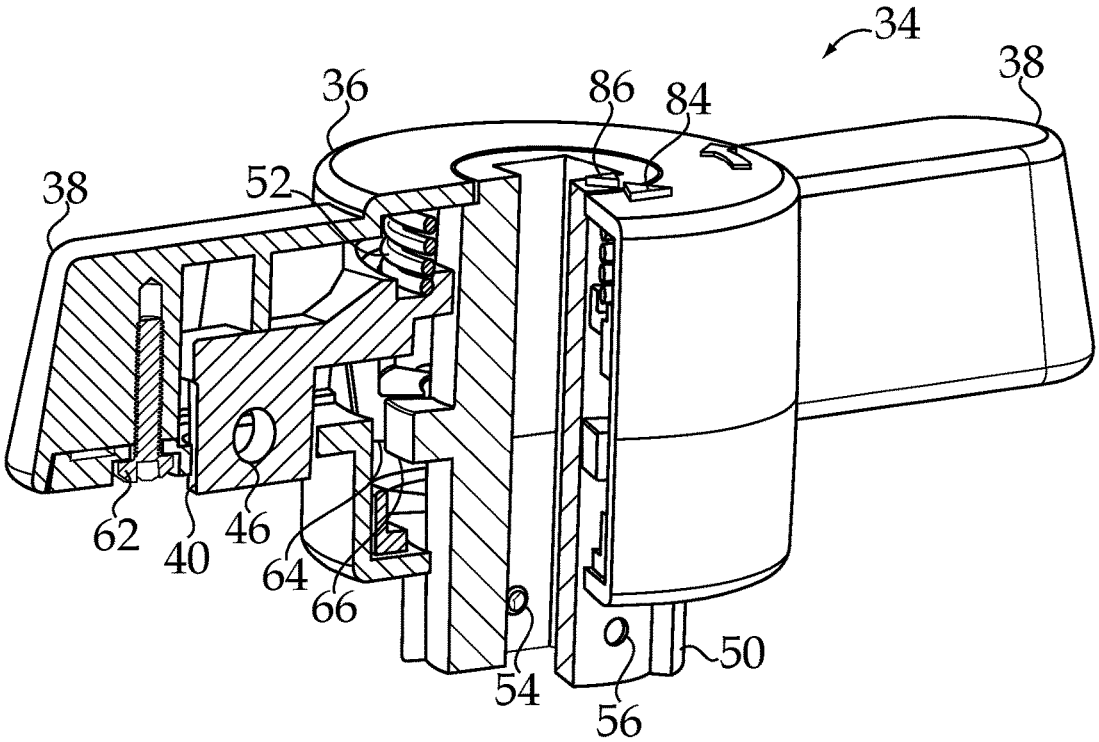
FIG. 8 illustrates some aspects of a non-limiting example of a clutch having a first clutch member in an engagement position relative to a second clutch member in accordance with an embodiment of the present invention.

When in the disengagement position, e.g., as illustrated in FIG. 7, clutch member 48 driving surfaces 68, 70 and 72 are disposed in an annular volume below (in the perspective of FIG. 6) teeth 66 of clutch member 50, above (in the perspective of FIG. 6) and bounded by interrupted surface 80, and radially within annular wall 82, illustrated in FIG. 6. When in the disengagement position, the driving and driven surfaces are not rotationally aligned, and hence a rotation of rotary handle 32 does not cause driving surfaces 68, 70 and 72 of driving teeth 64 to contact or engage driving surfaces 74, 76 and 78 of driven teeth. When clutch member 48 is in the disengagement position, rotary handle 34 and clutch member 48 may thus freewheel unimpeded about clutch member 50 in both clockwise and counterclockwise directions 28 and 30.

Clutch member 48 is displaced into the engagement position by rotating rotary handle 34 to align arrow 84 on rotary handle 34 with the arrow 86 on clutch member 50 (e.g., see FIGS. 4, 7 and 8), and depressing buttons 40, thereby translating clutch member 48 in axial engagement direction 42 and positioning driving teeth 64 circumferentially between driven teeth 66. In other embodiments, other marking schemes may be employed. Once in the engagement position, clutch 32 is engaged, and rotary handle 34 may be rotated in clockwise direction 28 to engage driving surfaces 68 and 70 against mating driven surfaces 74 and 76, or may be rotated in counterclockwise direction 30 driving surfaces 72 against mating driven surfaces 78.

Clutch member 48 and clutch member 50 include respective latching surfaces 88 and 90 that overlap to engage and latch clutch member 48 in the engagement position when clutch member 48 is displaced or translated into the engagement position and then rotated in clockwise direction 28, e.g., to turn circuit breaker 16 on. This allows the operator of circuit breaker system 10 to quickly turn circuit breaker 16 off by rotating rotary handle 34 in counterclockwise direction 30 without the necessity of pushing buttons 40 to engage clutch 32 again, since clutch 32 is retained in engagement by latching surfaces 88 and 90. When the operator rotates rotary handle 34 in counterclockwise direction 30 to turn circuit breaker 16 off, latching surfaces are moved out of overlap, thus unlatching clutch member 48, and continued rotation in counterclockwise direction 30 turns circuit breaker 16 off. Clutch member 48 is then returned to the disengagement position under the impetus of bias spring 52, decoupling clutch member 48 from clutch member 50 and thus disengaging dog clutch 32. In other embodiments, clutch member 48 and clutch member 50 may be configured with latching surfaces on the opposite sides of teeth 64 and 66 so as to latch clutch member 48 in the engagement position when rotated in counterclockwise direction 30.

Embodiments of the present invention include a circuit breaker system, comprising: an enclosure having a door coupled thereto for access to the interior of the enclosure; a circuit breaker disposed in the enclosure and having a shaft extending therefrom, wherein the shaft is operative to turn the circuit breaker on or off by rotation of the shaft; an external operating handle disposed outside the enclosure and coupled to the shaft through the door, wherein the external operating handle is operative to rotate the shaft; and an internal operating handle disposed inside the enclosure and coupled to the shaft, wherein the internal operating handle includes a dog clutch coupled to the shaft and a rotary handle coupled to the dog clutch; and wherein the rotary handle is operative to rotate the shaft only when the dog clutch is engaged.

In a refinement, the circuit breaker system further comprises a button operative to engage the dog clutch when the button is depressed, wherein the rotary handle is operative to freewheel without rotating the shaft when the button is not depressed.

In another refinement, the button is constructed to displace in an axial direction along the shaft relative to the rotary handle when depressed in order to engage the dog clutch.

In yet another refinement, the button extends from the rotary handle toward the circuit breaker and when depressed is displaced in an axial direction away from the circuit breaker into the rotary handle to engage the dog clutch.

In still another refinement, the dog clutch includes a first clutch member coupled to the rotary handle, and a second clutch member coupled to the shaft.

In yet still another refinement, the second clutch member is mounted on and affixed to the shaft.

In a further refinement, the first clutch member is mounted on the second clutch member; and the first clutch member is operative to displace axially along the second clutch member to engage and disengage the dog clutch.

In a yet further refinement, the dog clutch is constructed to rotationally couple the first clutch member with the second clutch member when the first clutch member is displaced in a first axial direction into an engagement position, and to rotationally decouple the first clutch member from the second clutch member when the first clutch member is displaced in a second axial direction opposite the first axial direction into a disengagement position.

In a still further refinement, the dog clutch is constructed to latch the first clutch member in the engagement position when the rotary handle is rotated in a first rotational direction while the first clutch member is in the engagement position; and wherein the dog clutch is constructed to unlatch the first clutch member when the rotary handle is subsequently rotated in a second rotational direction opposite the first rotational direction.

In a yet still further refinement, the rotation in the first rotational direction is operative to turn the circuit breaker on; and the subsequent rotation in the second rotational direction is operative to turn the circuit breaker off.

Embodiments of the present invention include a safety operating handle system for turning a shaft to operate a circuit breaker, comprising: a rotary handle; and a dog clutch having a first clutch member coupled to the rotary handle and having a second clutch member coupled to the shaft, wherein the dog clutch is operative to transmit a rotation of the rotary handle to the shaft when the first clutch member is in the engagement position; and wherein the dog clutch is not operative to transmit the rotation to the shaft when the first clutch member is not in the engagement position.

In a refinement, the safety operating handle system further comprises a button coupled to the first clutch member and operative to displace the first clutch member in an axial direction into an engagement position relative to the second clutch member.

In another refinement, the first clutch member has a clockwise driving surface and a counterclockwise driving surface; the second clutch member has a clockwise driven surface and a counterclockwise driven surface; and the clockwise driving surface and the counterclockwise driving surface are rotationally aligned to engage and transmit the rotation through the respective clockwise driven surface or the counterclockwise driven surface when the first clutch member is in the engagement position.

In yet another refinement, the safety operating handle system further comprises a biasing spring operative to bias the first clutch member toward a disengagement position, wherein the clockwise driving surface and the counterclockwise driving surface are not rotationally aligned when the first clutch member is in the disengagement position, and wherein the first clutch member is free to rotate about the second clutch member when the first clutch member is in the disengagement position.

In still another refinement, the second clutch member is mounted on and secured to the shaft.

In yet still another refinement, the first clutch member is mounted on the second clutch member.

In a further refinement, the first clutch member has a first latching surface and the second clutch member has a second latching surface operative to engage the first latching surface and to latch the first clutch member in the engagement position when the first clutch member is first displaced into the engagement position and then rotated in a first rotational direction.

In a yet further refinement, the first latching surface and the second latching surface are configured to disengage from each other and unlatch the first clutch member when the first clutch member is subsequently rotated in a second rotational direction opposite the first rotational direction.

In a still further refinement, the safety operating handle system further comprises a support bracket operative to support the shaft, wherein the support bracket is disposed between the rotary handle and the circuit breaker; and wherein the support bracket is constructed to mount on the circuit breaker or an enclosure.

Embodiments of the present invention include a circuit breaker system, comprising: an enclosure having a door coupled thereto for access to the interior of the enclosure; a circuit breaker disposed in the enclosure and having a shaft extending therefrom, wherein the circuit breaker is configured to be operated by a rotation of the shaft; an external operating handle disposed outside the enclosure and coupled to the shaft through the door, wherein the external operating handle is operative to rotate the shaft; and an internal operating handle disposed inside the enclosure and coupled to the shaft, wherein the internal operating handle includes means for selectively transmitting a rotation to the shaft.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A circuit breaker system, comprising:

an enclosure having a door coupled thereto for access to the interior of the enclosure;

a circuit breaker disposed in the enclosure and having a shaft extending therefrom, wherein the shaft is operative to turn the circuit breaker on or off by rotation of the shaft;

an external operating handle disposed outside the enclosure and coupled to the shaft through the door, wherein the external operating handle is operative to rotate the shaft;

an internal operating handle disposed inside the enclosure and coupled to the shaft, wherein the internal operating handle includes a dog clutch coupled to the shaft and a rotary handle coupled to the dog clutch, a portion of the dog clutch being axially displaceable within, and independent of axial displacement of, the rotary handle in a direction along the shaft between an engagement position and a disengagement position; wherein the rotary handle is operative to rotate the shaft only when the dog clutch is engaged, and wherein the rotary handle is operative to freewheel in both a clockwise and a counterclockwise direction when the dog clutch is not engaged.

2. The circuit breaker system of claim 1, further comprising a button operative to engage the dog clutch when the button is depressed, wherein the rotary handle is operative to freewheel without rotating the shaft when the button is not depressed.

3. The circuit breaker system of claim 2, wherein the button is constructed to displace in an axial direction along the shaft relative to the rotary handle when depressed in order to engage the dog clutch.

4. The circuit breaker system of claim 2, wherein the button extends from the rotary handle toward the circuit breaker and when depressed is displaced in an axial direction away from the circuit breaker into the rotary handle to engage the dog clutch.

5. The circuit breaker system of claim 1, wherein the dog clutch includes a first clutch member coupled to the rotary handle, and a second clutch member coupled to the shaft.

6. The circuit breaker system of claim 5, wherein the second clutch member is mounted on and affixed to the shaft.

7. The circuit breaker system of claim 5, wherein the first clutch member is mounted on the second clutch member; and wherein the first clutch member is operative to displace axially along the second clutch member to engage and disengage the dog clutch.

8. The circuit breaker system of claim 5, wherein the dog clutch is constructed to rotationally couple the first clutch member with the second clutch member when the first clutch member is displaced in a first axial direction into an engagement position, and to rotationally decouple the first clutch member from the second clutch member when the first clutch member is displaced in a second axial direction opposite the first axial direction into a disengagement position.

9. The circuit breaker system of claim 8, wherein the dog clutch is constructed to latch the first clutch member in the engagement position when the rotary handle is rotated in a first rotational direction while the first clutch member is in the engagement position; and wherein the dog clutch is constructed to unlatch the first clutch member when the rotary handle is subsequently rotated in a second rotational direction opposite the first rotational direction.

10. The circuit breaker system of claim 9, wherein the rotation in the first rotational direction is operative to turn the circuit breaker on; and wherein the subsequent rotation in the second rotational direction is operative to turn the circuit breaker off.

11. A safety operating handle system for turning a shaft to operate a circuit breaker, comprising:

a rotary handle; and a dog clutch having a first clutch member coupled to the rotary handle and having a second clutch member coupled to the shaft, the first clutch member having a first latching surface and the second clutch member having a second latching surface, the first latching surface and the second latching surface each configured to (1) retain the first clutch member in engagement with the second clutch member upon displacement of the dog clutch in a first rotational direction, and (2) accommodate disengagement of the first clutch member from engagement with the second clutch member after displacement of the clutch member in a second rotational direction, the first rotational direction being opposite of the second rotational direction;

wherein the dog clutch is operative to transmit a rotation of the rotary handle to the shaft when the first clutch member is in an engagement position; wherein the dog clutch is not operative to transmit the rotation to the shaft when the first clutch member is not in the engagement position, and wherein the rotary handle is operative to freewheel in both a clockwise and a counterclockwise direction when the dog clutch is not engaged.

12. The safety operating handle system of claim 11, further comprising a button coupled to the first clutch member and operative to displace the first clutch member in an axial direction into an engagement position relative to the second clutch member.

13. The safety operating handle system of claim 11, wherein the first latching surface of the first clutch member comprises either a clockwise driving surface or a counterclockwise driving surface, and the second latching surface of the second clutch member similarly comprises either a clockwise driven surface or a counterclockwise driven surface; and wherein the clockwise driving surface and the counterclockwise driving surface are rotationally aligned to engage and transmit the rotation through the respective clockwise driven surface or the counterclockwise driven surface when the first clutch member is in the engagement position.

14. The safety operating handle system of claim 13, further comprising a biasing spring operative to bias the first clutch member toward a disengagement position, wherein the clockwise driving surface and the counterclockwise driving surface are not rotationally aligned when the first clutch member is in the disengagement position, and wherein the first clutch member is free to rotate about the second clutch member when the first clutch member is in the disengagement position.

15. The safety operating handle system of claim 11, wherein the second clutch member is mounted on and secured to the shaft.

16. The safety operating handle system of claim 11, wherein the first clutch member is mounted on the second clutch member.

17. The safety operating handle system of claim 11, wherein a portion of the first latching surface is structured to overlap and a portion of the second latching surface upon displacement of the dog clutch in a first rotational direction.

18. The safety operating handle system of claim 11, wherein the first latching surface and the second latching surface are configured to retain an axial position of the first clutch member relative to the second clutch member upon displacement of the dog clutch in a first rotational direction.

19. The safety operating handle system of claim 11, further comprising a support bracket operative to support the shaft, wherein the support bracket is disposed between the rotary handle and the circuit breaker; and wherein the support bracket is constructed to mount on the circuit breaker or an enclosure.

20. A circuit breaker system, comprising:

an enclosure having a door coupled thereto for access to the interior of the enclosure;

a circuit breaker disposed in the enclosure and having a shaft extending therefrom, wherein the circuit breaker is configured to be operated by a rotation of the shaft;

an external operating handle disposed outside the enclosure and coupled to the shaft through the door, wherein the external operating handle is operative to rotate the shaft; and an internal operating handle disposed inside the enclosure and coupled to the shaft, wherein the internal operating handle includes a rotary handle and a clutch, the clutch being position and structured to selectively transmit a rotation to the shaft, and wherein the rotary handle is operative to freewheel in both a clockwise and a counterclockwise direction when the clutch is not engaged, wherein the clutch comprises a first clutch member and a second clutch member, a first latching surface of the first clutch member and a second latching surface of the second latch member being shaped and positioned to retain an axial position of the first clutch member relative to the second clutch member after displacement of the clutch in a first rotational direction.

* * * * *